US006669161B2

(12) United States Patent
Doucet et al.

(10) Patent No.: US 6,669,161 B2
(45) Date of Patent: Dec. 30, 2003

(54) SUPPORT SLAT

(75) Inventors: Jules Doucet, St-David de Falardeau (CA); Dominique Simard, Saguenay (CA)

(73) Assignee: PBI Industries Inc. (CA)

( * ) Notice: Subject to any disclaimer, the term of this patent is extended or adjusted under 35 U.S.C. 154(b) by 0 days.

(21) Appl. No.: 10/291,806

(22) Filed: Nov. 8, 2002

(65) Prior Publication Data

US 2003/0136892 A1 Jul. 24, 2003

(30) Foreign Application Priority Data

Nov. 9, 2001 (CA) ..... 2363299

(51) Int. Cl.[7] ..... A47B 9/00
(52) U.S. Cl. ..... 248/346.02; 108/56.3
(58) Field of Search ..... 248/346.02; 108/56.3, 108/54.1, 55, 57.25; 34/518

(56) References Cited

U.S. PATENT DOCUMENTS

| | | | | |
|---|---|---|---|---|
| 192,001 | A | 6/1877 | Pfeffer | |
| 851,789 | A | 4/1907 | Alexander | |
| 1,515,214 | A | 11/1924 | Kelleher et al. | |
| 1,608,918 | A | 11/1926 | Alexander | |
| 1,745,479 | A | 2/1930 | Few | |
| 2,614,689 | A | 10/1952 | Miller | 206/60 |
| 2,679,111 | A | 5/1954 | Leischner | 34/6 |
| 2,841,350 | A | 7/1958 | Chronister | 248/120 |
| 2,903,126 | A | 9/1959 | Heath | 206/46 |
| 3,454,156 | A | 7/1969 | Chatten | 206/65 |
| 3,480,178 | A | 11/1969 | Morgan | 220/97 |
| 3,567,068 | A | 3/1971 | Carfizzi | 220/69 |
| 3,691,965 | A | 9/1972 | Cloyd | 108/58 |
| 3,880,286 | A | 4/1975 | Wegener | 206/386 |
| 3,900,957 | A | 8/1975 | Denton et al. | 34/13.8 |
| 3,907,130 | A | 9/1975 | Hutcheson | 214/10.5 R |
| 4,293,605 | A | 10/1981 | Persson et al. | 428/126 |
| 4,316,419 | A | 2/1982 | Cupido | 108/56.1 |
| 4,375,265 | A | 3/1983 | van de Wetering et al. | 220/1.5 |
| 4,663,860 | A | 5/1987 | Beall | 34/13.4 |
| 4,788,777 | A | 12/1988 | Davis | 34/239 |
| 5,345,695 | A | 9/1994 | Graham | 34/94 |
| D378,347 | S | 3/1997 | Bain | D8/354 |
| 5,704,134 | A | 1/1998 | Carter et al. | 34/396 |
| 5,789,057 | A | 8/1998 | Naitou et al. | 428/73 |
| 5,813,137 | A | 9/1998 | Townsend | 34/518 |
| 5,860,369 | A * | 1/1999 | John et al. | 108/57.26 |
| 5,887,529 | A * | 3/1999 | John et al. | 108/56.1 |
| 6,134,803 | A | 10/2000 | Gilchrist et al. | 34/94 |
| 6,179,273 | B1 | 1/2001 | Edmunds, III et al. | 256/13.1 |
| 6,283,044 | B1 * | 9/2001 | Apps | 108/57.25 |
| 6,530,476 | B1 * | 3/2003 | Overholt | 206/386 |

* cited by examiner

*Primary Examiner*—Ramon O Ramirez
(74) *Attorney, Agent, or Firm*—Bourque & Associates, P.A.

(57) ABSTRACT

The support slat is in the form of an integrally-molded one-piece unit. It comprises a central section provided with a pair of spaced-apart and parallely-disposed side walls. The side walls are connected to each others by a plurality of spaced-apart transversal walls. The end sections are each having a beveled transversal edge, which defines an inclined surface contiguous with an upper load-supporting surface of the support slat. The support slat is particularly well adapted to be used with corresponding support beams, thereby allowing to solve the problem of direct contact between the belts and the upper surface of stacked articles. This is achieved without interfering with another stack placed above. Another advantage of using the support slat is that it allows to increase the sliding resistance of supporting beams.

12 Claims, 2 Drawing Sheets

SUPPORT SLAT

RELATED APPLICATION

The present application claims the benefits of Canadian Patent Application No. 2,363,299 filed Nov. 9, 2001 and U.S. patent application Ser. No. 10/071,436 filed Feb. 8, 2002, now U.S. Pat. No. 6,598,847 all of which are hereby incorporated by reference.

BACKGROUND

The present invention relates to a support slat that can be used during the handling of stacked articles or in any other such applicable situation. This support slat is notably well adapted for use with bundles of wood pieces, and in particular with plywood or particle boards, when used in conjunction with a corresponding support beam.

During the handling of stacked articles, it is important that the different sets of articles be stacked in a stable and secured fashion. This has not always been the case up to now, in particular for articles whose dimensions exceed those of a standard wood pallet. For example, in the case of plywood boards, a plurality of boards are placed one on top of the other and tightened with metallic belts or any other such fastener so that the whole be made integral. A pair of support beams, generally made from a solid piece of wood or from the superposition of particle boards nailed together and cut according to the desired length, are then placed under each bundle in order to space them from the floor, in the case of the bottom bundle, or from the top of a bundle located just below. This spacing allows the insertion of forks from a forklift under the bundle in order to lift and move it.

The one-piece integrally molded support beam, as described in U.S. Pat. No. 6,598,847,is a highly suitable alternative to the wooden support beams that were used until now. The use of this support beam allows an increased efficiency and a lower operation cost. It is reusable, waterproof, recyclable and provided with suitable phytosanitary properties.

When securing stacked articles, the tension in the belts are often very high. This may damage the edges of the articles. To solve this problem, it is common to use wood pieces in order to prevent direct contact between the horizontal and upper portions of the belts with the articles placed on the top of the stacks. These wood pieces have, however, the drawback of interfering with other stacks that may be placed directly on top thereof. The wood pieces provide very little or even no resistance to relative movement between the various stacks when placed on top each others. In certain circumstances, this may cause problems during truck transportation or the like, since the stacks may be subjected to forces urging them to move relative to each other.

Another drawback of using wood pieces is that they are not always uniform and may crack, rap or degrade over time. Restrictions regarding phytopathogens may also forbid their use with articles intended for exportation.

SUMMARY

The present invention is a support slat which is designed to solve the problem of direct contact between the belts and the article or articles placed on the tops of the stack, that being done without interfering with the other stacks that may be placed above. Another advantage of this support slat is that it allows to increase the sliding resistance of a support beam placed on top thereof, in particular during the transport of the stacks articles.

The invention will be better understood upon reading the following detailed description, which is made with reference to the appended figures.

DETAILED DESCRIPTION

Figure 1:
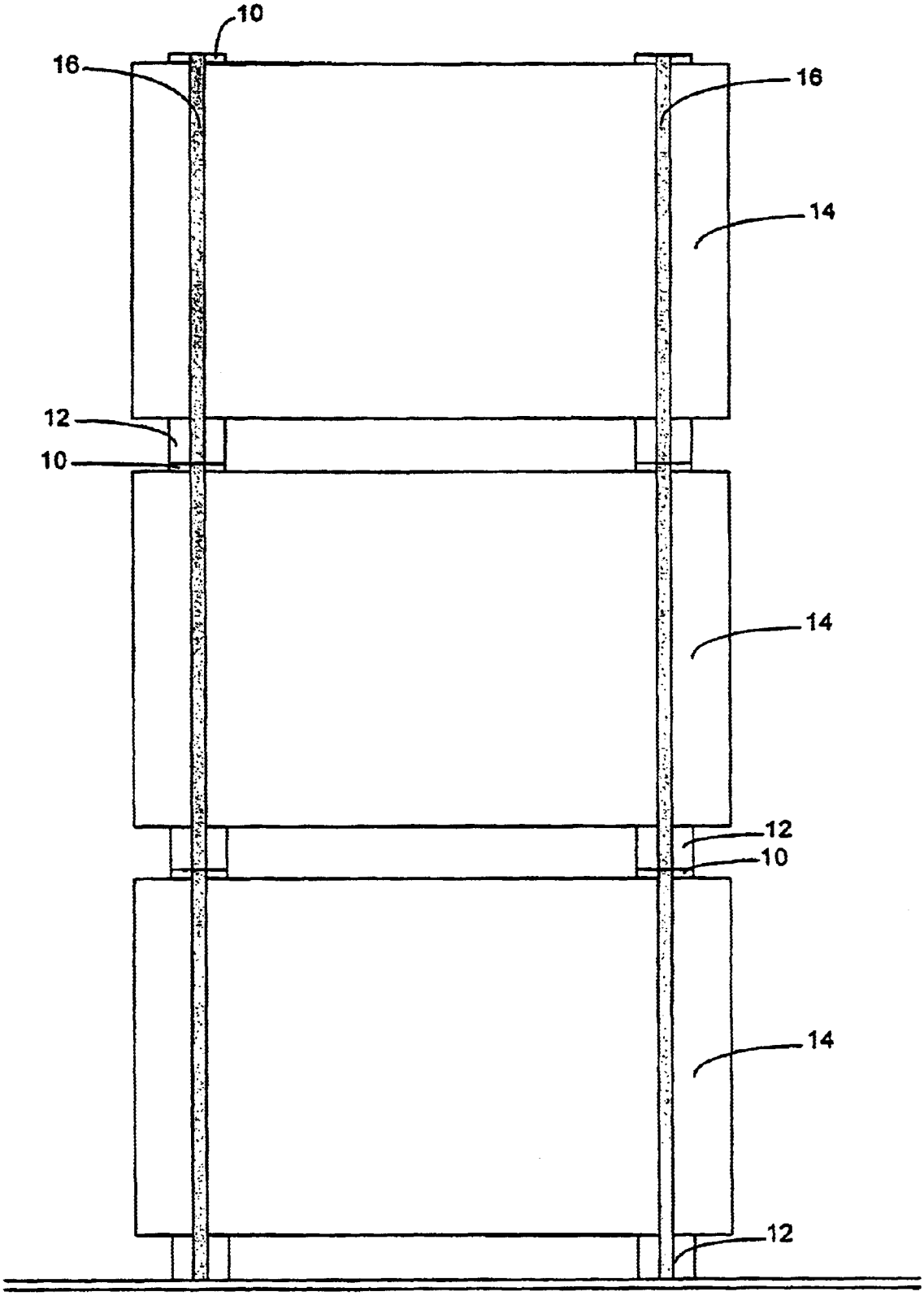
FIG. 1 is an elevation view showing an example of three stacks placed one over the other and spaced apart by support beams and support slats in accordance with a preferred embodiment.
Figure 3:
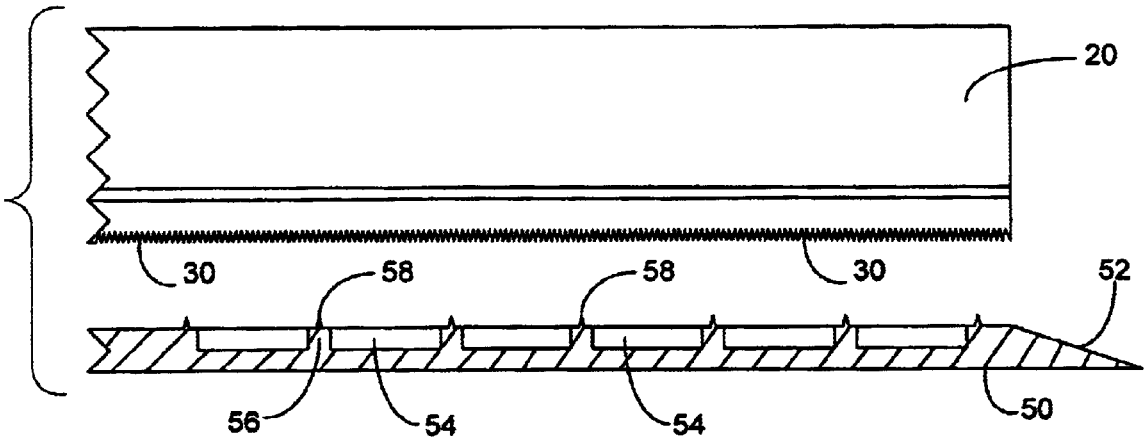
FIG. 3 is a side view of the end of the support slat shown in FIG. 2, the support slat being shown with the corresponding support beam.

FIGS. 1 and 3 show a preferred embodiment in which the support slats (10) are used in conjunction with support beam (12) as the one described in U.S. Pat. No. 6,598,847. However, it should be noted that the support slats (10) may be used without the support beams (12).

FIG. 1 illustrates a possible use of the support slats (10) and the support beams (12) in accordance with the preferred embodiment. In this example, the support slats (10) are used for receiving the upper portion of the belts (16), thereby preventing the belts (16) from directly being in engagement with the upper portion of the stack (14). Each stack (14) comprises a given number of articles placed one on top of the others. It should be noted that the present invention is not limited to articles made of wood. This invention may be used with any kind of material or in other context where its use may be advantageous.

Each stack (14) is preferably protected by a support slat (10) for each belt (16). The support slats (10) have a length equivalent to the spacing between each side of the stack (14). They are generally rectangular and elongated shape.

The support slats (10) and the corresponding support beams (12) are generally positioned before the stack (14) is attached by the belts (16). The belts (16) are then placed around the support slats (10) and the support beams (12), and then tightened until everything is secured. The support beams (12) protect the edges of the bottom articles of the stack (14).

The support slat (10) is made of a single molded piece. It comprises a central section **(10*a*) provided with a pair of spaced apart and parallely disposed side walls (10*b*) The side walls (10*b*) are linked together by means of a plurality of transversal walls (10*c*), which are spaced from one another and integrally linked to the side walls (10*b*). It should be noted that the transversal walls (10*c*) and the side walls (10*b*) are located within a space defined by an upper load-supporting surface and a bottom supporting surface. The transversal walls (10*c*) and the side walls (10*b*) are preferably provided between the same limits. However, it is possible to have the transversal walls (10*c*) being higher than the side walls (10*b*)**.

Each of the transversal walls **(10*c*) is provided with an upper longitudinal edge which is coplanar with the upper load-supporting surface. The upper longitudinal edge of at least two transversal walls (10*c*) is provided with an elongated tooth (10*d*) that is longitudinally disposed with reference to the corresponding transversal wall (10*c*) and projecting upwards. The teeth (10*d*) are designed to mesh with the bottom teeth (12*a*) of a support beam (12) which would be placed on top thereof, thereby increasing the friction between them in the longitudinal direction of the support slats (10) and the support beams (12). This set of teeth (10***d*) of each support slat (10) meshes with a compatible multiple with the bottom teeth (12*a*) of the support beams (12). The teeth (10*d*, 12*a*) are preferably having a relatively small height and it should be noted that those illustrated in FIG. 2 have exaggerated dimensions for the purpose of illustration. A typical height for a tooth (10*d*, 12*a*) is 1/16 of an inch. The support slats (10) may also be provided with teeth (10*d*) having a shape and a configuration which differs from that shown in the figures. The support beams (12) will then be provided with corresponding teeth. For example, the teeth (10*d*) may be shaped as a "V" when seen from above or provided with any possible other shape. The teeth (10*d*) are preferably provided in a parallel and straight configuration since this prevents from having to align the stacks in a proper fashion.

Each support slat (10) also comprises two end sections (10*e*). Each end section (10*e*) transversally disposed and integrally linked to a corresponding end of the side walls (10*b*). The end sections (10*e*) are thus in opposition. Each end section (10*e*) has a beveled transversal edge (10*f*) which defines an inclined surface contiguous with the upper load-supporting surface. The beveled edge (10*f*) insures a progressive transition between the horizontal and vertical portions of the belt (16). The inclined surface may be flat, curved or with a plurality of small flat and parallel strips. The average angle is preferably between 10 and 25° with reference to the upper load supporting surface. However, the angle may be different than those values.

Figure 2:
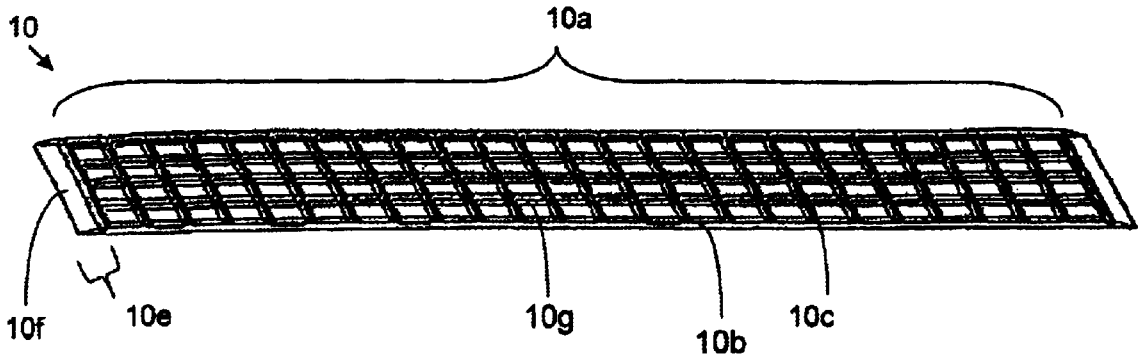
FIG. 2 is a perspective view of a support slat in accordance with a preferred embodiment.

The support slat (10) is advantageously provided with at least one longitudinal wall (10*g*) linking at least two of the transversal walls (10*c*). Preferably, each support slat (10) is provided with a plurality of longitudinal walls (10*g*) extending between the end sections (10*e*). The longitudinal walls (10*g*) define, with the transversal walls (10*c*) and the side walls (10*b*), a plurality of cells. As illustrated in FIG. 2, the upper load supporting surface is therefore a perforated surface rather than a flat surface.

In accordance with the preferred embodiment, the bottom support surface is closed between the side walls (10*b*) and the end sections (10*e*) by a bottom wall (10*h*), the underside of the bottom of the wall (10*h*) defining the bottom supporting surface. The bottom wall (10*h*) is preferably flat. However, other shapes or configurations are also possible, depending on the needs. The bottom wall (10*h*) is integral with the side walls (10*b*), transversal walls (10*c*) and longitudinal walls (10*g*). It should be noted that the side walls (10*b*) may be completely integrated with the sides of the bottom wall (10*h*). Yet, the support slat (10) may be without a bottom.

The bottom slats (10) are preferably made of a rigid plastic material or any other polymeric material or composite material having a sufficient strength or a strength higher than that they have to support. The preferred materials are low density polyethylene (LDPE), high density polyethylene (HDPE), polypropylene (PP) or a mixed thereof. The support slats (10) may also be made in other materials. It is also possible to combine many materials for manufacturing them, using for instance reinforcing materials. Composite material may include wood dust (or wood chips) mixed with one of the polymers. The proportion of wood dust may be up to 85% in weight and may even be higher, in accordance with the strength required and the polymeric material that is used.

Although a preferred embodiment of the present invention was disclosed in details and illustrated in the appended figures, the present invention is not limited to this so preferred embodiment and many changes and modifications may be put therein without departing from the scope or spirit of the present invention. For example, the exact construction of the various parts of the support slat (10) depends on its use. It is thus possible to construct a support slat (10) with a shape and configuration different than that is illustrated. It should be also noted that the support slats (10) and the supporting beams (12) are not necessarily having the same length, although they must be aligned with reference to the other when in use.

What is claimed is:

1. A one-piece integrally-molded support slat having an upper load-supporting surface and a bottom supporting surface, the support slat comprising:

a central section comprising:

a pair of spaced apart and parallely disposed side walls; and a plurality of spaced apart transversal walls integrally connected to the side walls, each of the transversal walls having an upper longitudinal edge which is coplanar with the upper load-supporting surface; and two end sections, each end section being transversally disposed and integrally connected to a corresponding end of the side walls, each end section having a transversal beveled edge, the transversal beveled edge defining an inclined surface contiguous with the upper load-supporting surface.

2. A support slat in accordance with claim 1, wherein the support slat comprises at least one longitudinally extending wall connected to at least two transversal walls.

3. A support slat in accordance with claim 1, further comprising a plurality of longitudinal walls extending between the end sections.

4. A support slat in accordance with claim 1, wherein the bottom support surface is closed between the side walls and the end sections by a bottom wall, the underside of the bottom wall defining the bottom supporting surface.

5. A support slat in accordance with claim 4, wherein the bottom supporting surface is flat.

6. A support slat in accordance with claim 1, wherein the inclined surface has an average angle between 10 and 25 with reference to the upper load supporting surface.

7. A support slat in accordance with claim 1, wherein at least two transversal walls are provided with an upward projecting tooth.

8. A support slat in accordance with claim 1, wherein the support slat is made of a polymeric material.

9. A support slat in accordance with claim 8, wherein the polymeric material is selected in a group consisting of low density polyethylene (LDPE), high density polyethylene (HDPE), polypropylene (PP) and a mixed thereof.

10. A support slat in accordance with claim 1, wherein the support slat is made of a composite material.

11. A support slat in accordance with claim 10, wherein the composite material comprises wood dust and at least one other material selected in a group consisting of low density polyethylene (LDPE), high density polyethylene (HDPE), polypropylene (PP) or a mixed thereof.

12. A support slat in accordance with claim 11, wherein the wood dust is in a proportion from more than 0 to 85% in weight.

* * * * *